US008857233B2

(12) United States Patent
Nakazato et al.

(10) Patent No.: US 8,857,233 B2
(45) Date of Patent: Oct. 14, 2014

(54) PIPE BENDING PROCESSING APPARATUS

(75) Inventors: Kazuhiko Nakazato, Koga (JP); Yoshiaki Amasaki, Koga (JP); Kazuhiro Nagaoka, Koga (JP)

(73) Assignee: Sanoh Industrial Co., Ltd., Tokyo (JP)

( * ) Notice: Subject to any disclaimer, the term of this patent is extended or adjusted under 35 U.S.C. 154(b) by 167 days.

(21) Appl. No.: 13/696,622

(22) PCT Filed: Mar. 9, 2011

(86) PCT No.: PCT/JP2011/056145

§ 371 (c)(1),
(2), (4) Date: Nov. 7, 2012

(87) PCT Pub. No.: WO2011/142173

PCT Pub. Date: Nov. 17, 2011

(65) Prior Publication Data

US 2013/0047691 A1 Feb. 28, 2013

(30) Foreign Application Priority Data

May 13, 2010 (JP) ..... 2010-111472

(51) Int. Cl.
*B21D 7/02* (2006.01)

(52) U.S. Cl.
CPC ..... *B21D 7/02* (2013.01)
USPC ..... 72/149

(58) Field of Classification Search
CPC ..... B21D 7/02; B21D 7/024; B21D 7/025; B21D 7/04
USPC ..... 72/31.04, 149–159, 249, 369
See application file for complete search history.

(56) References Cited

U.S. PATENT DOCUMENTS

| | | | | |
|---|---|---|---|---|
| 4,961,335 | A | 10/1990 | Kimura | |
| 4,986,104 | A * | 1/1991 | Caporusso et al. | 72/149 |
| 6,766,675 | B2 | 7/2004 | Suzuki et al. | |
| 7,234,333 | B2 * | 6/2007 | Maier et al. | 72/156 |

FOREIGN PATENT DOCUMENTS

| | | |
|---|---|---|
| JP | 02-165819 A | 6/1990 |
| JP | 07-236921 A | 9/1995 |

(Continued)

OTHER PUBLICATIONS

International Search Report of the International Searching Authority mailed May 17, 2011 for the corresponding international application No. PCT/JP2011/056145 (with English translation).

*Primary Examiner* — Teresa M Ekiert
(74) *Attorney, Agent, or Firm* — Posz Law Group, PLC

(57) ABSTRACT

An object of the invention is to provide a compact and inexpensive pipe bending processing apparatus. To attain this object, provided is a pipe bending processing apparatus which positions a pipe with respect to a bending roll in response to the rotation of a rotary shaft, and bends the pipe by moving the pipe along the bending roll while pressing the pipe against the bending roll, wherein an outer cylinder in which a linear slit is formed along a bus line and a circumferential slit extending in a circumferential direction is formed at an upper end of the linear slit is arranged in a machine casing, an inner cylinder formed with a spiral groove is rotatably arranged inside the outer cylinder, the rotary shaft is inserted into the inner cylinder so as to be vertically movable and rotatable, a pin is provided in a protruding manner at the rotary shaft and is inserted into the spiral groove of the inner cylinder and into the linear slit of the outer cylinder, the inner cylinder is linked to an output shaft of a rotary actuator, and the rotary shaft is lifted and is also rotated at an uppermost position by the rotary actuator.

2 Claims, 7 Drawing Sheets

(56) References Cited

FOREIGN PATENT DOCUMENTS

| | | | |
|---|---|---|---|
| JP | 2002-316218 | A | 10/2002 |
| JP | 2003-305518 | A | 10/2003 |
| JP | 2006-170031 | A | 6/2006 |

* cited by examiner

PIPE BENDING PROCESSING APPARATUS

TECHNICAL FIELD

The present invention relates to a pipe bending processing apparatus. More specifically, the present invention relates to a pipe bending processing apparatus which is provided with a bending roll and in which a pipe is positioned with respect to the circumferential surface of the bending roll, a presser is revolved with respect to the bending roll while the portion of the pipe to be bent is clamped between the bending roll and the presser, and the pipe is bent and deformed along the bending roll.

BACKGROUND ART

Japanese Patent Application Publication No. 2003-305518 discloses a pipe bending processing apparatus which is provided with a bending roll and in which a pipe is positioned with respect to the circumferential surface of the bending roll, a presser is revolved with respect to the bending roll while the portion of the pipe to be bent is clamped between the bending roll and the presser, and the pipe is bent and deformed along the bending roll.

In the pipe bending processing apparatus disclosed in the aforementioned Japanese Patent Application Publication, a clamp and the presser are supported so that they can be brought into contact with and withdrawn from the bending roll, the apparatus is provided with a rotary plate that is disposed rotatably about an axis coaxial with the bending roll axis and, in addition to the rotary plate, with a fixed plate provided with cams that determine the movement trajectory of the clamp and presser, and the pipe bending processing is performed by rotating the rotary plate with one actuator.

In the pipe bending processing apparatus disclosed in the aforementioned Japanese Patent Application Publication, although one actuator is sufficient for performing the pipe bending processing, a separate actuator is necessary for lifting the bending processing apparatus to the level of the supported pipe.

DISCLOSURE OF THE INVENTION

The present invention has been created to resolve the above-mentioned problem and it is an object of the present invention to reduce further the number of actuators, thereby providing a more compact and less expensive pipe bending processing apparatus by using the actuator serving to lift the bending processing apparatus to the pipe level as the actuator to be used for bending the pipe.

In order to attain the above-described object, the first aspect of the present invention provides a pipe bending processing apparatus having an apparatus main body including positioning means for positioning a pipe with respect to a bending roll in response to rotation of a rotary shaft, and deformation means for bending the pipe by moving the pipe along the bending roll while pressing the pipe against the bending roll, wherein an outer cylinder in which a linear slit is formed along a bus line and a circumferential slit extending in a circumferential direction is formed at an upper end of the linear slit is arranged in a machine casing, an inner cylinder formed with a spiral groove is rotatably arranged inside the outer cylinder, the rotary shaft is inserted into the inner cylinder so as to be vertically movable and rotatable, a pin is provided in a protruding manner at the rotary shaft and is inserted into the spiral groove of the inner cylinder and into the linear slit of the outer cylinder, the inner cylinder is linked to an output shaft of a rotary actuator, and the rotary shaft is lifted and is also rotated at an uppermost position by the rotary actuator.

With the bending processing apparatus according to the first aspect of the present invention, the operation of lifting the apparatus main body to the pipe position and the operation of positioning the pipe with respect to the bending roll and moving the pipe along the bending roll and bending the pipe, while pressing the pipe against the bending roll, are performed by one actuator. Therefore, the apparatus is reduced in size and cost.

The second aspect of the present invention provides the pipe bending processing apparatus according to the first aspect of the present invention, wherein the bending roll is arranged to be movable back and forth with respect to the pipe, a groove cam is formed in a bottom surface of the bending roll, a plate-shaped arm is fixedly installed at the rotary shaft, a pin is vertically arranged on an upper surface of the plate-shaped arm and is inserted into the groove cam of the bending roll, the plate-shaped arm is rotated following the rotation of the rotary shaft, and the bending roll is moved toward the pipe by the pin and the cam groove of the bending roll.

With the bending processing apparatus according to the second aspect of the present invention, the bending roll can be moved so as to be brought close to the pipe. Therefore, a bending roll flanged at both sides can be used and more accurate bending processing can be performed.

BEST MODE FOR CARRYING OUT THE INVENTION

The pipe bending processing apparatus in accordance with the present invention is explained in detail below with reference to the appended drawings.

Figure 1:
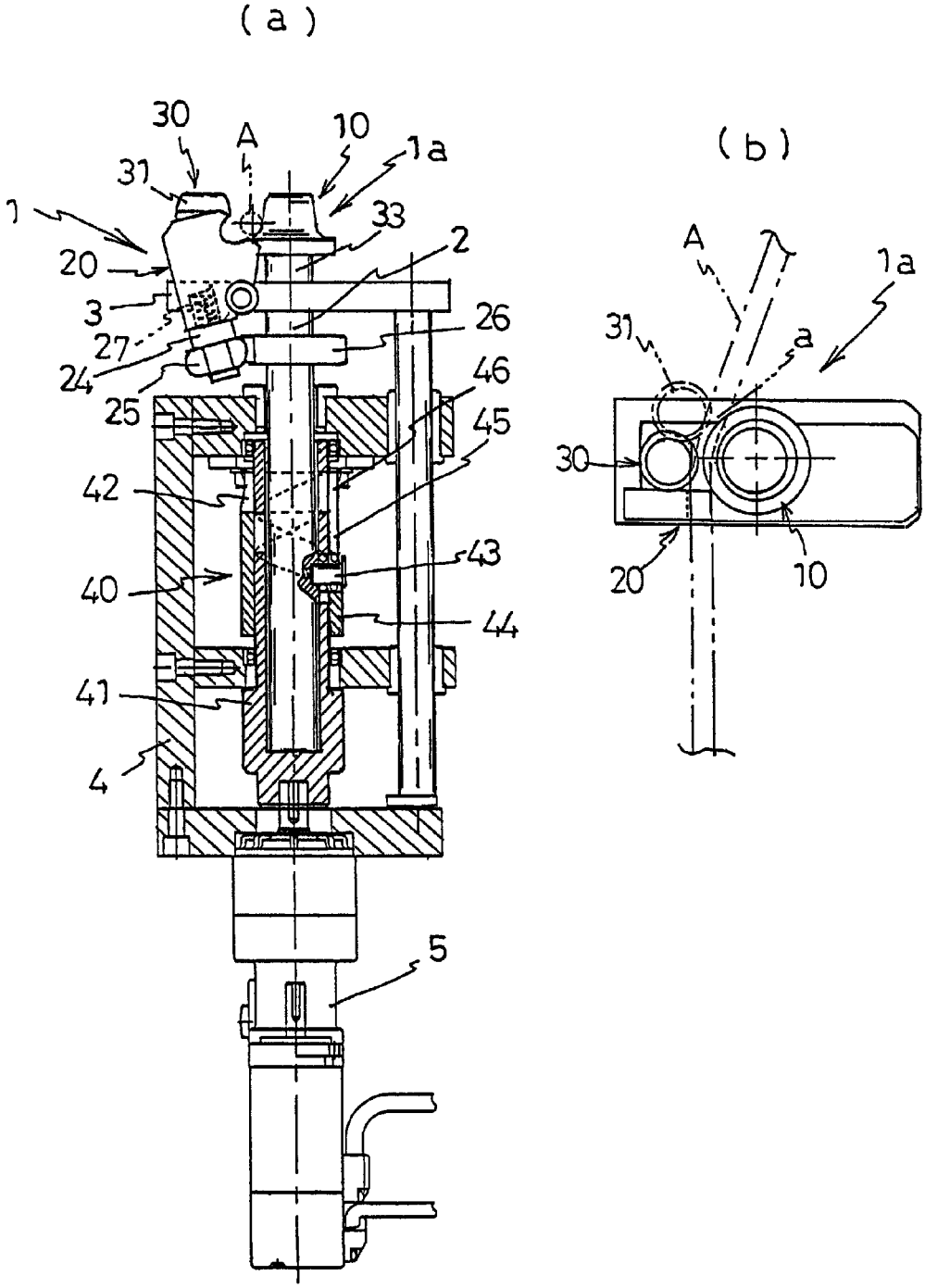
FIG. 1 illustrates schematically an embodiment of the pipe bending processing apparatus in accordance with the present invention, wherein FIG. 1(*a*) is a partial sectional side view and FIG. 1(*b*) is a plane view.

A pipe bending processing apparatus 1 shown in FIG. 1 is provided with a bending roll 10 and includes an apparatus main body 1*a* constituted by positioning means 20 for positioning a pipe (A) with respect to the circumferential surface of the bending roll 10 and deformation means 30 for revolving a portion (a) where the pipe (A) is to be bent with respect to the bending roll 10 and bending and deforming, while clamping with the bending roll 10, and lifting means 40 for lifting-lowering and actuating the apparatus main body 1*a*.

Figure 2:
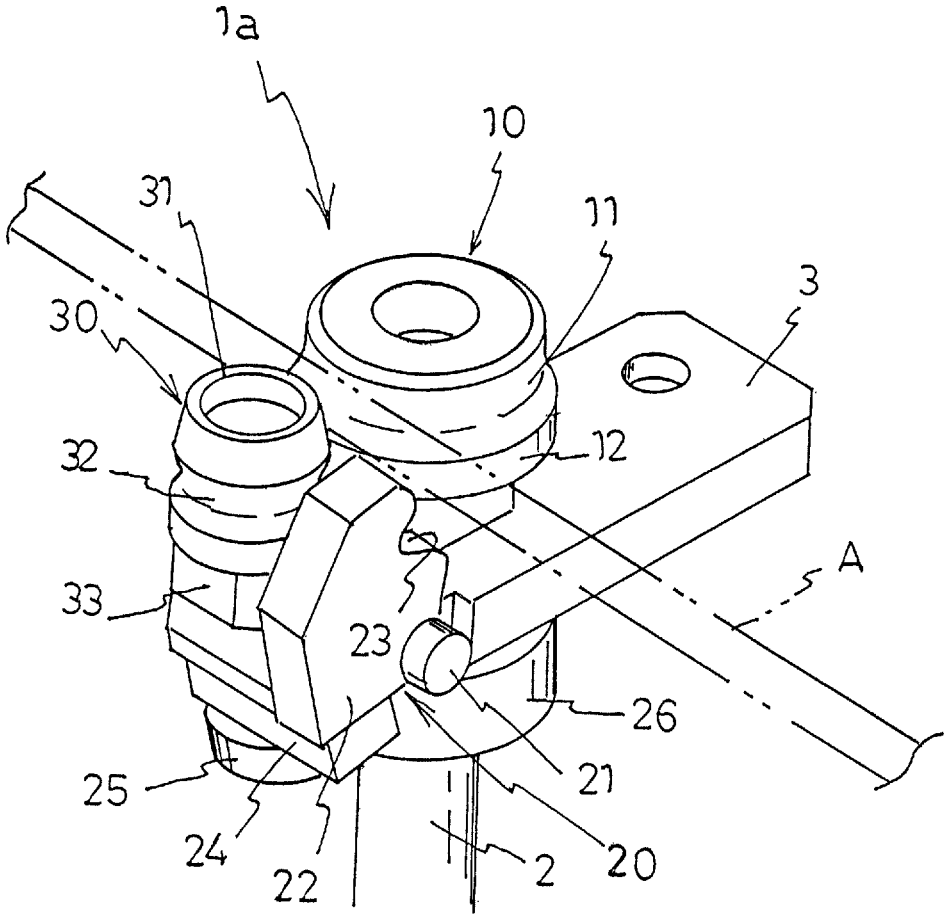
FIG. 2 is a perspective view of the apparatus main body shown in FIG. 1 that is taken from one direction.

As shown in FIG. 2, the bending roll 10 has a flange 12 at the lower end of a circumferential surface 11, and a curved surface corresponding to the diameter of the pipe (A) is formed in the adjoining section of the circumferential surface 11 and the flange 12. A rotary shaft 2 extending downward is vertically arranged in the center of the bottom surface of the bending roll 10. The rotary shaft 2 is freely fit into a base plate 3.

The positioning means 20 is provided with a positioning block 22 that is rotatably supported by a shaft 21 at the side surface of the base plate 3. A recess 23 is formed in the positioning block 22. The recess 23 is formed as a curved surface corresponding to the diameter of the pipe (A). A roller 25 is disposed on the bottom surface of the positioning block 22, with a bracket 24 being interposed therebetween. A roll-shaped cam 26 is provided at the rotary shaft 2 concentrically therewith. As shown in FIG. 1(*a*), a spring 27 is interposed between the bracket 24 and the base plate 3, and the roller 25 is pressed against the cam 26 by the biasing force of the spring 27.

Figure 3:
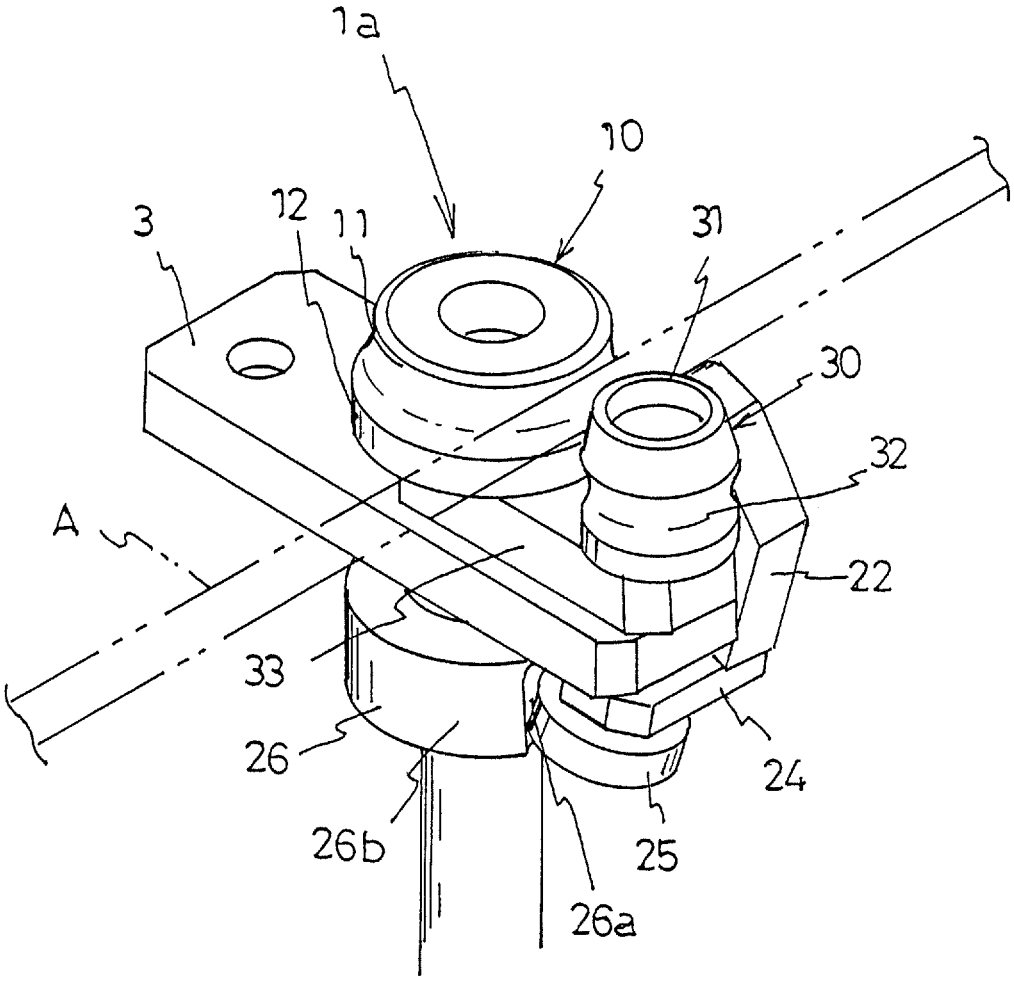
FIG. 3 is a perspective view of the apparatus main body shown in FIG. 1 that is taken from another direction.
Figure 4:
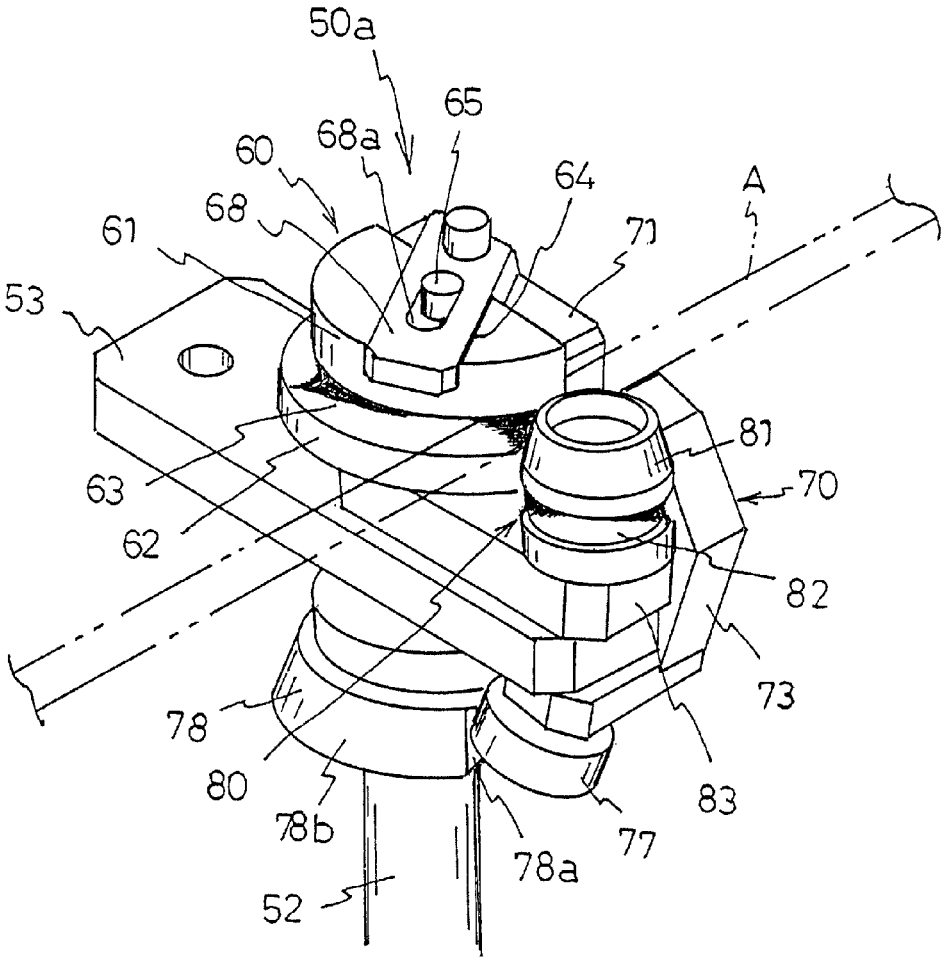
FIG. 4 is a perspective view taken from one direction and illustrating another embodiment of the apparatus main body in the pipe bending processing apparatus in accordance with the present invention.

With such positioning means 20, when the roller 25 is positioned in a valley 26*a* of the cam 26, the block 22 is positioned at a distance from the pipe (A), as shown in FIG. 3, and when the roller 25 is positioned at a peak 26*b* of the cam 26, the recess 23 is positioned so as to abut against the pipe (A).

The deformation means 30 is provided with a roll-shaped presser 31. An annular recess 32 corresponding to the diameter of the pipe (A) is formed in the circumferential surface of the presser 31. The presser 31 is supported on a plate-shaped arm 33, and the plate-shaped arm 33 is fixedly mounted on the rotary shaft 2.

In the deformation means 30, the plate-shaped arm 33 rotates about the rotary shaft 2 by following the rotation of the rotary shaft 2, and the presser 31 supported on the plate-shaped arm 33 moves along the circumferential surface of the bending roll 10 and bends and deforms the pipe (A), as shown by a two-dot-dash line in FIG. 1(*b*).

In the lifting means 40, as shown in FIG. 1(*a*), a motor 5 is disposed on a machine casing 4, an inner cylinder 41 is connected to the output shaft of the motor, and the lower portion of the rotary shaft 2 of the apparatus main body 1*a* is fitted into the inner cylinder 41. A spiral groove 42 is formed in the inner cylinder 41. Meanwhile, a pin 43 is vertically arranged on the circumferential surface of the rotary shaft 2, and the pin 43 is inserted into the spiral groove 42 of the inner cylinder 41.

An outer cylinder 44 fixedly attached to the machine casing 4 is fitted onto the outer circumference of the inner cylinder 41. A linear slit 45 is formed in the outer cylinder 44 along the bus line thereof, and the pin 43 of the rotary shaft 2 is inserted into the slit 45. A circumferential slit 46 is extended along the circumferential direction from the upper end of the linear slit 45. The circumferential slit 46 is set within a range in which the movement of the presser 31 is allowed.

In the pipe bending processing apparatus 1 of the above-described configuration, where the motor 5 is driven, first, the interval between the circumferential surface of the bending roll 10 of the apparatus main body 1*a* and the annular recess 32 of the presser 31 is raised by the lifting means 40 to reach the pipe (A). In other words, where the motor 5 is driven in the lifting means 40, the inner cylinder 41 is rotated. Where the inner cylinder 41 is rotated, the pin 43 is lifted while being guided by the linear slit 45 of the outer cylinder 44, the rotary shaft 2 rises, and the apparatus main body 1*a* is also lifted. In this case, since the movement of the pin 43 in the rotation direction is restricted by the linear slit 45, the rotary shaft 2 is not rotated. Where the pin 43 reaches the uppermost position in the linear slit 45, the pin 43 is released from the linear slit 45. Therefore, the pin 43 moves along the circumferential slit 46. In other words, the rotary shaft 2 is rotated.

Where the rotary shaft 2 is rotated, the cam 26 is accordingly rotated and the roller 25 runs on the peak 26*b* of the cam 26. Therefore, the block 22 is rotated about the shaft 21, and the recess 23 is engaged with the pipe (A). As a result, the pipe (A) is positioned between the block 22 and the bending roll 10.

At the same time, the plate-shaped arm 33 is also rotated about the rotary shaft 2, and the presser 31 revolves with respect to the bending roll 10. Therefore, the pipe (A) is bent along the bending roll 10.

Where the pipe (A) is thus processed to a predetermined angle, the drive of the motor 5 is stopped. Where the motor 5 is then driven in reverse, the operations reversed with respect to the above-described operations restore the original state.

FIGS. 4 to 7 illustrate another embodiment of the apparatus main body in the pipe bending processing apparatus in accordance with the present invention.

An apparatus main body 50*a* of this bending processing apparatus is provided with a bending roll 60 and provided with positioning means 70 for positioning the pipe (A) with respect to the circumferential surface of the bending roll 60, and deformation means 80 for revolving the portion (a) where the pipe (A) is to be bent with respect to the bending roll 60 and bending and deforming, while clamping with the bending roll 60.

Figure 5:
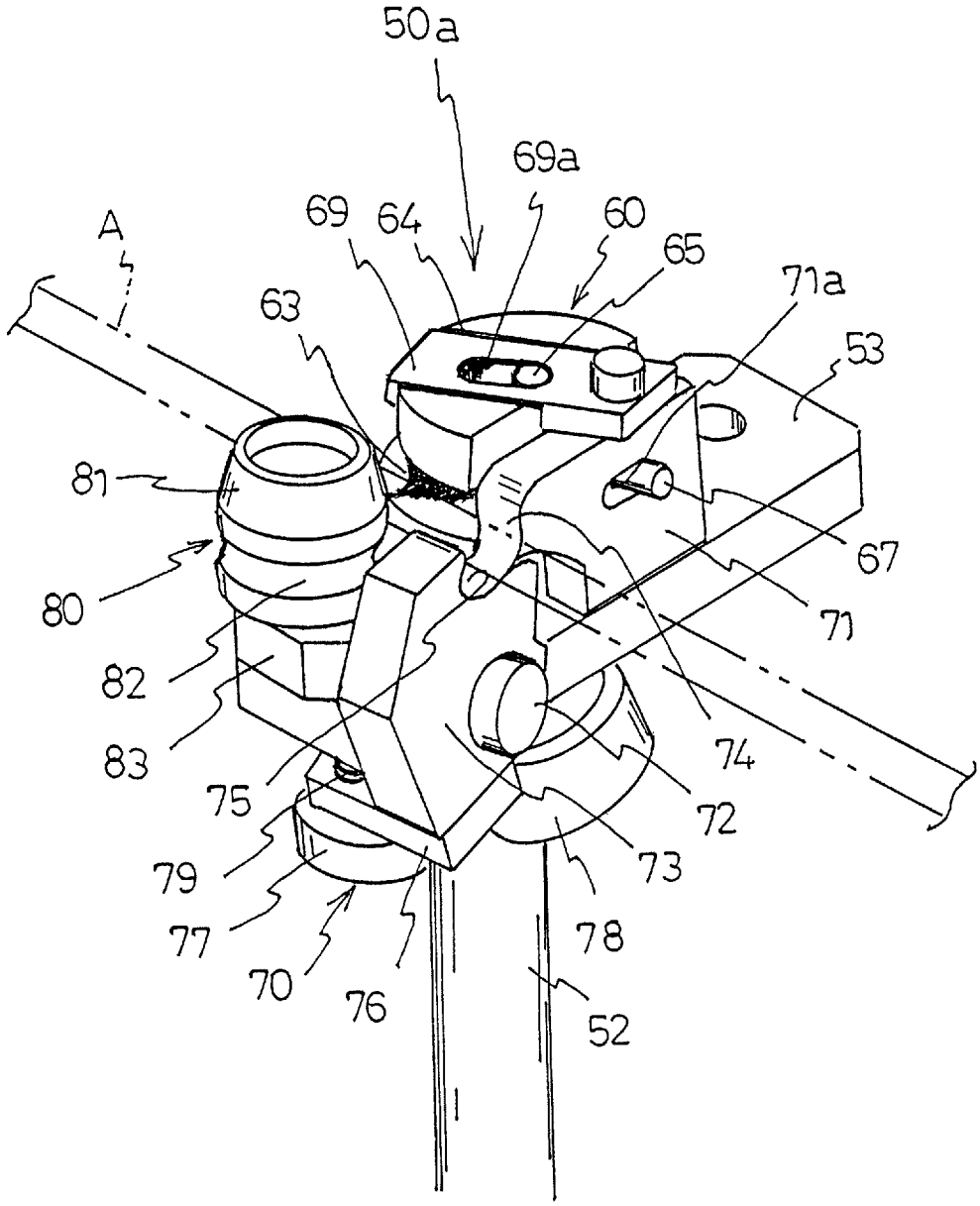
FIG. 5 is a perspective view of the apparatus main body shown in FIG. 4 that is taken from another direction.
Figure 7:
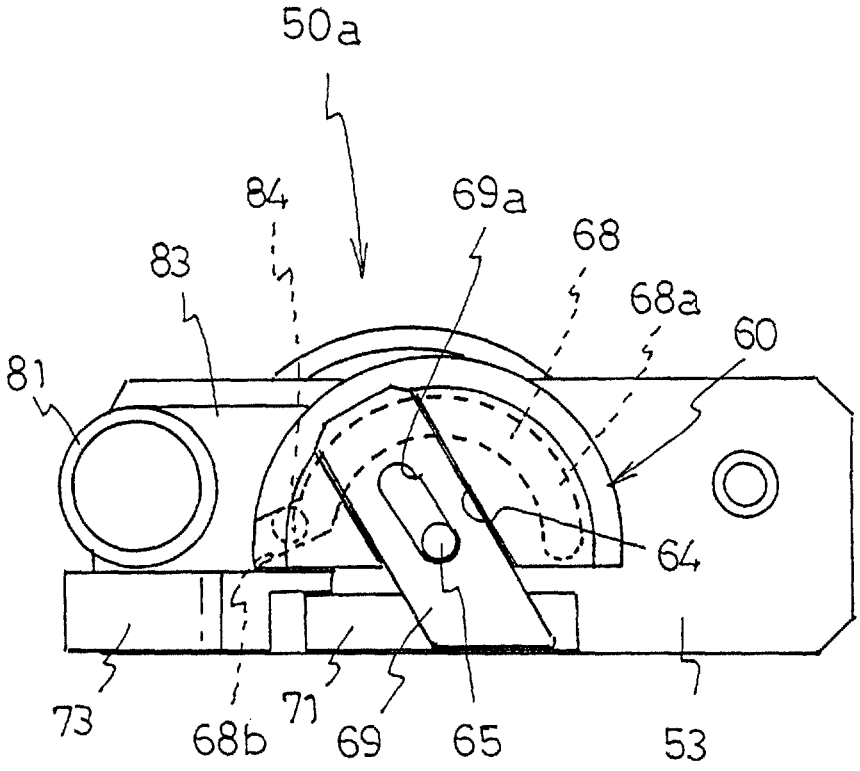
FIG. 7 is a plane view of the apparatus main body shown in FIG. 4.

The bending roll 60 has a substantially semi-circular shape with a portion thereof being cut out. A flange 62 is provided below a circumferential surface 61, and a recess 63 corresponding to the diameter of the pipe (A) is formed in the circumferential surface 61. A guide groove 64 extending obliquely is formed in the upper surface of the bending roll 60, and a pin 65 is vertically arranged in the central portion of the guide groove 64. Further, as shown in FIG. 5, a pin 67 is also vertically arranged at the cut-out surface of the bending roll 60. As shown in FIG. 7, a groove cam 68 including a substantially semicircular track 68*a* and a track 68*b* extending substantially radially from the end portion of the track 68*a* is formed at the bottom surface of the bending roll 60.

Further, in the bending roll 60, a guide piece 69 fixed to the upper surface of the below-described fixed block of the positioning means 70 is fitted in the guide groove 64, the pin 65 is inserted into a long hole 69*a* formed in the guide piece 69, and the pin 67 is inserted into and supported by the below-described long hole formed in the fixed block. Therefore, the bending roll 60 is moved along the guide piece 69.

As shown in FIG. 5, the positioning means 70 is provided with the fixed block 71 arranged vertically on the upper surface of the side portion of a base plate 53 and a rotary block 73 rotatably supported by a shaft 72 on the side surface of the base 53.

A protruding portion 74 formed as a curved surface corresponding to the diameter of the pipe (A) is formed in the surface of the fixed block 71 on the rotary block 73 side. A long hole 71*a* parallel to the base plate 53 is formed in the central portion of the fixed block 71.

A recess 75 is formed in the surface of rotary block 73 on the fixed block 71 side. The bottom surface section of the recess 75 is formed as a curved surface corresponding to the diameter of the pipe (A). A roller 77 is provided at the bottom surface of the rotary block 73, with a bracket 76 being interposed therebetween.

Figure 6:
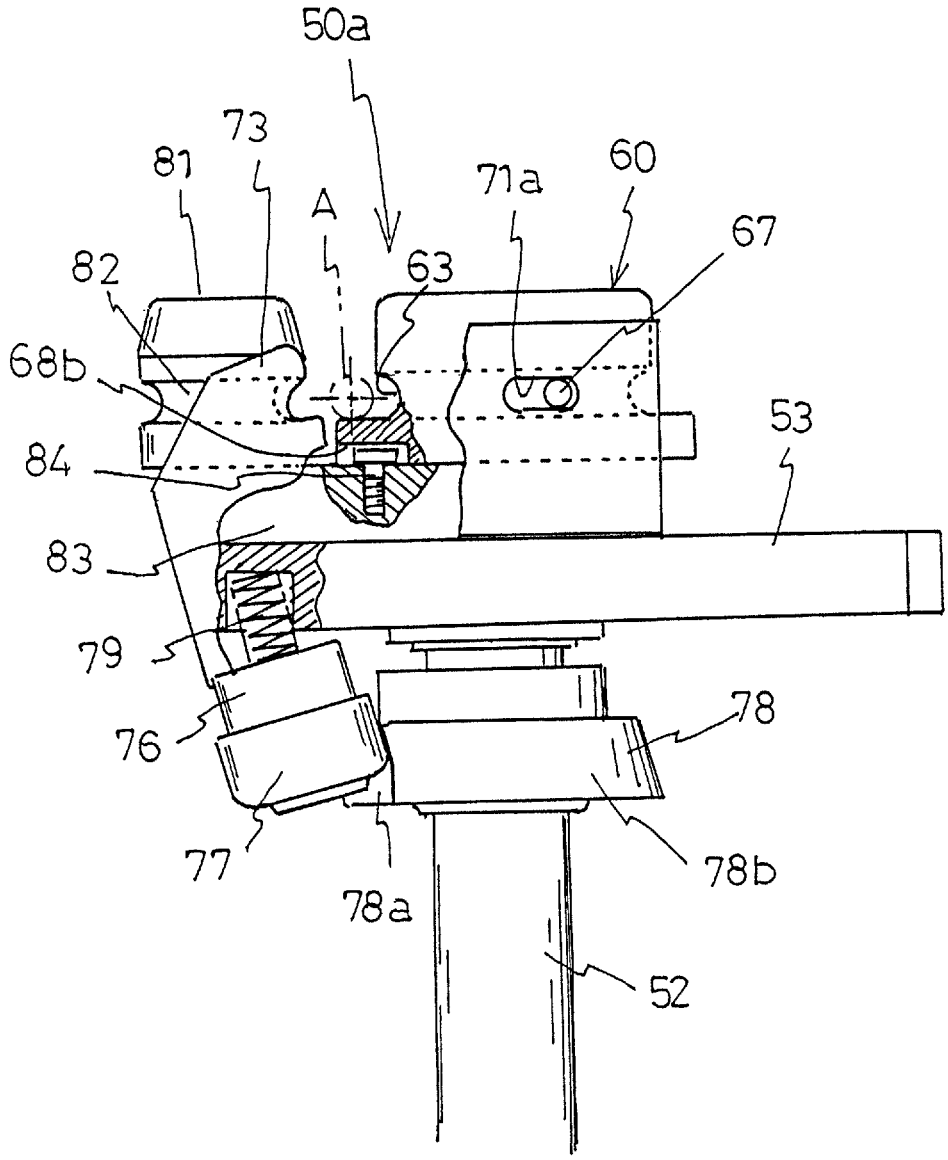
FIG. 6 is a side view showing a cross section of part of the apparatus main body shown in FIG. 4.

A cam 78 in the form of a truncated cone is provided concentrically at the rotary shaft 52. As shown in FIG. 6, a spring 79 is interposed between the bracket 76 and the base plate 53, and the roller 77 is pressed against the cam 78 by the biasing force of the spring 79.

The deformation means 80 is provided with a roll-shaped presser 81. An annular recess 82 corresponding to the diameter of the pipe (A) is formed in the circumferential surface of the presser 81. The presser 81 is supported at the plate-shaped arm 83, and the plate-shaped arm 83 is fixedly attached to the rotary shaft 52. As shown in FIGS. 6 and 7, a pin 84 that is fitted in the groove cam 68 formed in the bending roll 60 is vertically arranged at the upper surface of the plate-shaped arm 83.

In the deformation means 80, the plate-shaped arm 83 rotates about the center of the rotary shaft 52 by following the rotation of the rotary shaft 52, and the presser 81 moves along the circumferential surface of the bending roll 60 and bends and deforms the pipe (A).

Further, where the plate-shaped arm 83 is rotated, the pin 84 is pressed against the side wall of the track 68*b* of the groove cam 68, and the bending roll 60 is guided by the guide piece 69 and moved in the direction of the pipe (A). Therefore, the pipe (A) is accommodated inside the recess 63 of the bending roll 60.

The apparatus main body 50*a* is lifted and actuated by the lifting means 40 of the above-described embodiment.

In the pipe bending processing apparatus 50 of the above-described configuration, where the motor 5 is driven, first, the interval between the circumferential surface of the bending roll 60 of the apparatus main body 50*a* and the annular recess 82 of the presser 81 is raised to reach the pipe (A) by the lifting means 40. In this case, since the movement of the pin 43 in the rotation direction is restricted by the linear slit 45, the rotary shaft 52 is not rotated. Where the pin 43 reaches the uppermost position in the linear slit 45, the pin 43 is released from the linear slit 45. Therefore, the pin 43 moves along the circumferential slit 46. In other words, the rotary shaft 52 is rotated.

Where the rotary shaft 52 is rotated, the cam 78 is accordingly rotated and the roller 77 runs on the peak 78*b* of the cam 78. Therefore, the rotary block 73 is rotated about the shaft 72, and the recess 75 is engaged with the pipe (A). As a result, the pipe (A) is clamped by the rotary block 73 and the fixed block 71.

At the same time, the plate-shaped arm 83 is also rotated about the rotary shaft 52. As a result, the bending roll 60 is moved by the pin 84 toward the pipe (A), and the pipe (A) is accommodated between the recess 63 of the bending roll 60 and the recess 82 of the presser 81. Further, the presser 81 revolves with respect to the bending roll 60. Therefore, the pipe (A) is bent along the bending roll 10.

The embodiments of the pipe bending processing apparatus in accordance with the present invention are explained above, but the present invention is not limited to the above-described embodiments and can be variously changed and modified without departing from the technical scope of the present invention defined by the claims.

Industrial Applicability

With the pipe bending processing apparatus in accordance with the present invention that is explained hereinabove, the apparatus is made compact and reduced in cost. Therefore, this apparatus can be widely used for bending pipes to be used in automobiles and the like.

The invention claimed is:

1. A pipe bending processing apparatus comprising an apparatus main body having positioning means for positioning a pipe with respect to a bending roll in response to rotation of a rotary shaft, and deformation means for bending the pipe by moving the pipe along the bending roll while pressing the pipe against the bending roll, wherein an outer cylinder in which a linear slit is formed along a bus line and a circumferential slit extending in a circumferential direction is formed at an upper end of the linear slit is arranged in a machine casing, an inner cylinder formed with a spiral groove is rotatably arranged inside the outer cylinder, the rotary shaft is inserted into the inner cylinder so as to be vertically movable and rotatable, a pin is provided in a protruding manner at the rotary shaft and is inserted into the spiral groove of the inner cylinder and into the linear slit of the outer cylinder, the inner cylinder is linked to an output shaft of a rotary actuator, and the rotary shaft is lifted and is also rotated at an uppermost position by the rotary actuator.

2. The pipe bending processing apparatus according to claim 1, wherein the bending roll is arranged to be movable back and forth with respect to the pipe, a groove cam is formed in a bottom surface of the bending roll, a plate-shaped arm is fixedly installed at the rotary shaft, a pin is vertically arranged on an upper surface of the plate-shaped arm and is inserted into the groove cam of the bending roll, the plate-shaped arm is rotated following the rotation of the rotary shaft, and the bending roll is moved toward the pipe by the pin and the cam groove of the bending roll.

* * * * *